US010315877B2

(12) United States Patent
Zhou

(10) Patent No.: US 10,315,877 B2
(45) Date of Patent: Jun. 11, 2019

(54) DOUBLE-COILING-BELT PAPER MONEY TEMPORARY STORAGE DEVICE

(71) Applicant: GRG BANKING EQUIPMENT CO., LTD., Guangzhou, Guangdong (CN)

(72) Inventor: Zhiyuan Zhou, Guangdong (CN)

(73) Assignee: GRG BANKING EQUIPMENT CO., LTD., Guangzhou, Guangdong (CN)

( * ) Notice: Subject to any disclaimer, the term of this patent is extended or adjusted under 35 U.S.C. 154(b) by 93 days.

(21) Appl. No.: 15/535,916

(22) PCT Filed: Aug. 24, 2015

(86) PCT No.: PCT/CN2015/087898
§ 371 (c)(1),
(2) Date: Jun. 14, 2017

(87) PCT Pub. No.: WO2016/101645
PCT Pub. Date: Jun. 30, 2016

(65) Prior Publication Data
US 2018/0354737 A1 Dec. 13, 2018

(30) Foreign Application Priority Data
Dec. 25, 2014 (CN) ..... 2014 1 0827210

(51) Int. Cl.
*B65H 29/00* (2006.01)
*G07D 11/16* (2019.01)
*G07D 11/00* (2019.01)

(52) U.S. Cl.
CPC ..... *B65H 29/006* (2013.01); *G07D 11/00* (2013.01); *G07D 11/16* (2019.01);
(Continued)

(58) Field of Classification Search
CPC ..... B65H 29/006; B65H 5/28; B65H 2301/41912
See application file for complete search history.

(56) References Cited

U.S. PATENT DOCUMENTS 7,014,188 B2 * 3/2006 Polidoro ..... B65H 29/006 271/216
8,893,921 B2 * 11/2014 Miki ..... B65H 29/006 221/71

(Continued)

FOREIGN PATENT DOCUMENTS

CN 1578971 A 2/2005
CN 1991919 A 7/2007

(Continued)

OTHER PUBLICATIONS

Extended European Search Report for corresponding Application No. 15871719.9 dated Dec. 14, 2017.
International Search Report for PCT/CN2015/087898, dated Nov. 25, 2015, ISA/CN.

*Primary Examiner* — Luis A Gonzalez
(74) *Attorney, Agent, or Firm* — Yue(Robert) Xu; Apex Attorneys at Law, LLP

(57) ABSTRACT

A double-tape banknote temporary storage device is provided, which includes a banknote temporary storage reel, a pair of tape withdrawing reel assemblies, a pair of tapes, a pair of tape pressing wheels. The double-tape banknote temporary storage device further includes a planetary gear decelerating motor and a synchronous gear transmission system, and a driving gear is provided on an output shaft of the planetary gear decelerating motor. The synchronous gear transmission system includes a first gear, a first transmission gear set engaged with the driving gear and transmitting power to both of the banknote temporary storage reel and the first tape withdrawing reel assembly simultaneously, and a second transmission gear set connecting the first gear and the second tape withdrawing reel assembly and transmitting power to the second tape withdrawing reel assembly.

14 Claims, 5 Drawing Sheets

(52) U.S. Cl.
CPC ..... *B65H 2301/41912* (2013.01); *B65H 2403/41* (2013.01); *B65H 2701/1912* (2013.01); *G07D 2211/00* (2013.01)

(56) References Cited

U.S. PATENT DOCUMENTS

| | | | | |
|---|---|---|---|---|
| 9,704,324 | B2 * | 7/2017 | Nunn | B65H 29/006 |
| 2003/0116400 | A1 | 6/2003 | Saltsov et al. | |
| 2009/0108115 | A1 | 4/2009 | Iwatsuki | |
| 2010/0100245 | A1 | 4/2010 | Oishi et al. | |
| 2011/0079675 | A1 | 4/2011 | Iwatsuki et al. | |
| 2011/0093116 | A1 * | 4/2011 | Nunn | B65H 29/006 700/219 |
| 2012/0103754 | A1 | 5/2012 | Robinson et al. | |

FOREIGN PATENT DOCUMENTS

| | | | |
|---|---|---|---|
| CN | 101423151 | A | 5/2009 |
| CN | 101955081 | A | 1/2011 |
| CN | 102044109 | A | 5/2011 |
| CN | 102272801 | A | 12/2011 |
| CN | 102667879 | A | 9/2012 |
| CN | 103466387 | A | 12/2013 |
| CN | 103588013 | A | 2/2014 |
| CN | 104528046 | A | 4/2015 |
| JP | H0867382 | A | 3/1996 |
| JP | 2007290850 | A | 11/2007 |
| WO | 2012008026 | A1 | 1/2012 |

* cited by examiner

DOUBLE-COILING-BELT PAPER MONEY TEMPORARY STORAGE DEVICE

This application is a National Phase entry of PCT Application No. PCT/CN2015/087898, filed Aug. 24, 2015, which claims the priority to Chinese patent application No. 201410827210.8 titled "DOUBLE-TAPE BANKNOTE TEMPORARY STORAGE DEVICE", filed with the Chinese State Intellectual Property Office on Dec. 25, 2014, the entire disclosure of which are incorporated herein by reference.

FIELD

The present application relates to sheet-type medium temporary storage apparatuses, and more particularly to a banknote temporary storage device used in a financial mechanism, in which banknotes are wrapped by two layers of tapes, and are held between the double tapes and are wound on a banknote temporary storage reel to be temporarily stored.

BACKGROUND

In a financial self-service apparatus, a stack of banknotes is required to be separated from each other for being verified one by one, and then identification means such as image identification, thickness detection, magnetic information detection is performed on an individual banknote so as to ensure the authenticity of the processed banknotes. During the whole processing, the banknotes which have been verified are required to be stored temporarily, and the temporarily stored banknotes will be released and conveyed to a designated position until the process of the whole stack of banknotes are completed.

Currently, a banknote-type medium temporary storage apparatus generally temporarily stores banknotes on a cylindrical banknote temporary storage reel by wrapping the banknotes by two layers of tapers, so as to achieve the function of temporary storage of banknotes in the apparatus. The two layers of tapes are respectively received on another two cylindrical reels, i.e., tape withdrawing reels, by rolling. Such a manner for temporarily storing banknotes requires a motor to drive the banknote temporary storage reel for receiving the two layers of tapes and banknotes held by the two layers of tapes, and also requires another motor to synchronously drive the two tape withdrawing reels for respectively withdrawing the two tapes. The method for controlling and conveying same tapes by two motors has a synchronous matching issue, which imposes high requirement on structural assembling and a control system, and is apt to subject a dual function that tapes slip with respect to the banknote temporary storage reel or the tape temporary storage reel and the tapes are tensioned. Thus, the service life of the tapes will be reduced for long term use, and then the fault rate will be increased, the stability of the apparatus will be reduced, and employing two motors also imposes higher requirement on capacity of the apparatus, causing a waste of resources and increasing energy consumption of the apparatus.

SUMMARY

In order to address the issues in the conventional technology that a double-tape banknote temporary storage device has a matching difference in the synchronous driving of double motors and wastes resource and increases energy consumption of an apparatus, a double-tape banknote temporary storage device is provided according to the present application, which is driven by a single motor and overcomes the issues in the conventional technology.

The double-tape banknote temporary storage device, includes a banknote temporary storage reel, a pair of tape withdrawing reel assemblies, a pair of tapes, and a pair of tape pressing wheels. The banknote temporary storage reel is configured to wind a pair of tapes with banknotes stored the pair of tapes. The pair of tape withdrawing reel assemblies are a first tape withdrawing reel assembly and a second tape withdrawing reel assembly which have the same structure, and the first tape withdrawing reel assembly and the second tape withdrawing reel assembly are located respectively at two sides of the banknote temporary storage reel and are each configured to wind an individual tape after banknotes are released. Two ends of the pair of tapes align with each other and are fixed onto the banknote temporary storage reel, and another ends of the pair of tapes are fixed respectively onto the first tape withdrawing reel assembly and the second tape withdrawing reel assembly. The pair of tape pressing wheels is located between the banknote temporary storage reel and tape withdrawing reels, for pressing the two ends, close to the banknote temporary storage reel, of the pair of tapes and forming a stretch of double-tape conveying passage. Specifically, the double-tape banknote temporary storage device further includes a planetary gear decelerating motor and a synchronous gear transmission system, and a driving gear is provided on an output shaft of the planetary gear decelerating motor, and the synchronous gear transmission system is configured to transmit power of the planetary gear decelerating motor to both of the banknote temporary storage reel and the pair of tape withdrawing reel assemblies simultaneously. Specifically, the synchronous gear transmission system includes a first gear configured to drive the banknote temporary storage reel, a first transmission gear set engaged with the driving gear and transmitting power to both of the banknote temporary storage reel and the first tape withdrawing reel assembly simultaneously, and a second transmission gear set connecting the first gear and the second tape withdrawing reel assembly and transmitting power to the second tape withdrawing reel assembly.

Preferably, the first tape withdrawing reel assembly includes a first counterclockwise one-way drive gear, a first clockwise one-way bearing fixing seat, a first torsion limiter, a first rotating shaft and a first tape withdrawing reel. Specifically, an inner ring of the first torsion limiter is fixed onto the first rotating shaft by a cylindrical pin, and a pin key on an outer ring of the first torsion limiter is engaged with a pin key on an inner ring of the first tape withdrawing reel. The first clockwise one-way bearing fixing seat is arranged at the right of the first torsion limiter, an inner ring of the first clockwise one-way bearing fixing seat is sleeved on the first rotating shaft, and an outer ring of the first clockwise one-way bearing fixing seat is fixed to a sheet metal side plate. The first counterclockwise one-way drive gear is arranged at the right of the first clockwise one-way bearing fixing seat, and an inner ring of the first counterclockwise one-way drive gear is sleeved on the first rotating shaft and the first counterclockwise one-way drive gear is engaged with the first transmission gear set.

Specifically, the first transmission gear set includes a coaxial gear set and a first transmission gear. The coaxial gear set includes a large gear and a small gear which are arranged coaxially, and the large gear is engaged with the driving gear and is also engaged with the first counterclockwise one-way drive gear, so as to transmit power of the driving gear to the first counterclockwise one-way drive gear and further drive the first tape withdrawing reel assembly to rotate.

Specifically, the first transmission gear is located between the small gear and the first gear, and is engaged with the small gear and the first gear to transmit the power of the driving gear to the first gear and further drive the banknote temporary storage reel to rotate.

Preferably, the second tape withdrawing reel assembly includes a second counterclockwise one-way drive gear, a second clockwise one-way bearing fixing seat, a second torsion limiter, a second rotating shaft and a second tape withdrawing reel. Specifically, an inner ring of the second torsion limiter is fixed onto the second rotating shaft by a cylindrical pin, and a pin key on an outer ring of the second torsion limiter is engaged with a pin key on an inner ring of the second tape withdrawing reel. The second clockwise one-way bearing fixing seat is arranged at the right of the second torsion limiter, an inner ring of the second clockwise one-way bearing fixing seat is sleeved on the second rotating shaft, and an outer ring of the second clockwise one-way bearing fixing seat is fixed to a sheet metal side plate. The second counterclockwise one-way drive gear is arranged at the right of the second clockwise one-way bearing fixing seat, and an inner ring of the second counterclockwise one-way drive gear is sleeved on the second rotating shaft and the second counterclockwise one-way drive gear is engaged with the second transmission gear set.

Specifically, the second transmission gear set includes a second coaxial gear set and a second transmission gear. The second coaxial gear set includes a second large gear and a second small gear which are coaxially arranged, the second small gear is engaged with the second transmission gear, the second transmission gear is also engaged with the first gear, and the second large gear is engaged with the second counterclockwise one-way drive gear to transmit power of the driving gear to the second counterclockwise one-way drive gear and further drive the second tape withdrawing reel to rotate.

Preferably, the first transmission gear set and the second transmission gear set are two-stage decelerating gears.

Preferably, a clutch is provided on the output shaft of the planetary gear decelerating motor for replacing the driving gear, and is configured to achieve engagement and disengagement of the output shaft of the planetary gear decelerating motor and the synchronous gear transmission system. When power is off and the apparatus is stopped, the output shaft of the planetary gear decelerating motor may be separated from the gear at an input end of the synchronous gear transmission system by the clutch, therefore, the synchronous gear transmission system may be driven by a manual operation, and maintenance of the double-tape banknote temporary storage device is performed when power is off.

Specifically, the clutch includes a clutch gear, a split washer and a hollow clutch movable shaft, the clutch gear is sleeved on the clutch movable shaft, and is axially limited on the clutch movable shaft by the split washer and a retaining edge of the clutch movable shaft. An engaging boss structure is provided at one side of the clutch gear, and the clutch gear is rotatable freely on the clutch movable shaft, and an inner surface of the clutch movable shaft is provided with screw threads. A clutch engaging block is further provided on the output shaft of the planetary gear decelerating motor, and the clutch is secured onto the output shaft of the planetary gear decelerating motor by the screw threads on the inner surface of the clutch movable shaft, and the clutch is engaged with the clutch engaging block by the engaging boss structure on the side of the clutch gear for achieving torque transmission.

Compared with the conventional technology, the double-tape banknote temporary storage device has the following advantages.

1. The double-tape banknote temporary storage device employs a single motor to control the double tapes to convey, which ensures the unidirectionality of the driving, avoids the synchronous matching difference in the case that two motors are employed to drive, reduces the dual function of tape slipping and tensioning the tape, prolongs service life of the tapes, reduces fault rate, and improves stability of the apparatus.

2. The double-tape banknote temporary storage device driven by a single motor also saves resources, reduces requirement for capacity of the apparatus, and reduces energy consumption of the apparatus.

3. The double-tape banknote temporary storage device is equipped with a clutch, which allows the apparatus to be maintained when power is off, allows trouble to be shot rapidly and more efficient, and facilitates maintenance.

DETAILED DESCRIPTION

For further illustrating the double-tape banknote temporary storage device according to the present application, the present application is further described in detail with reference to an illustration of a preferred embodiment of the present application.

Figure 1:
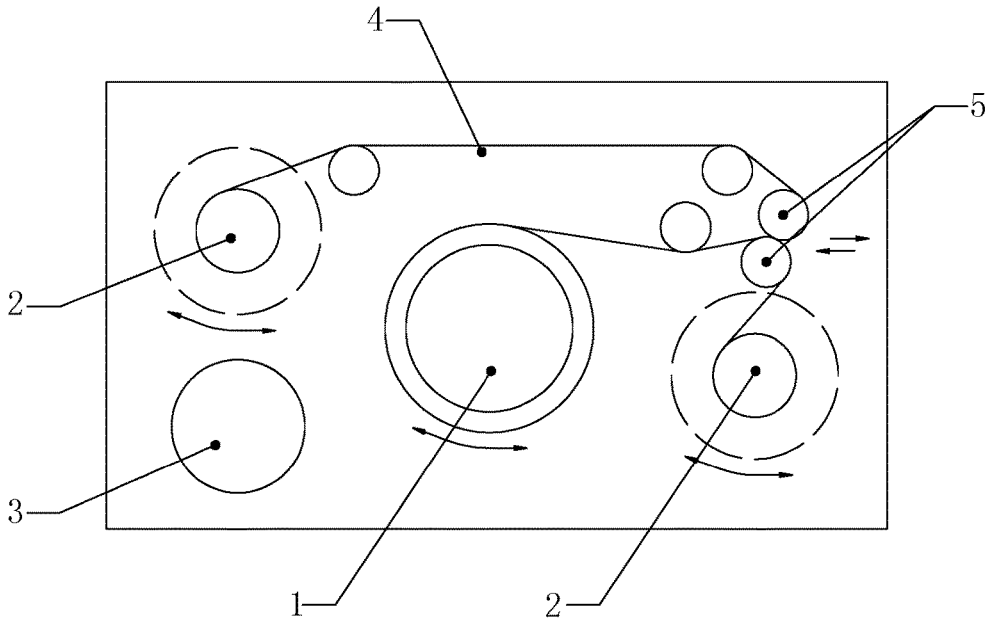
FIG. 1 is a schematic view showing the structure of a double-tape banknote temporary storage device according to a preferred embodiment of the present application.
Figure 2A:
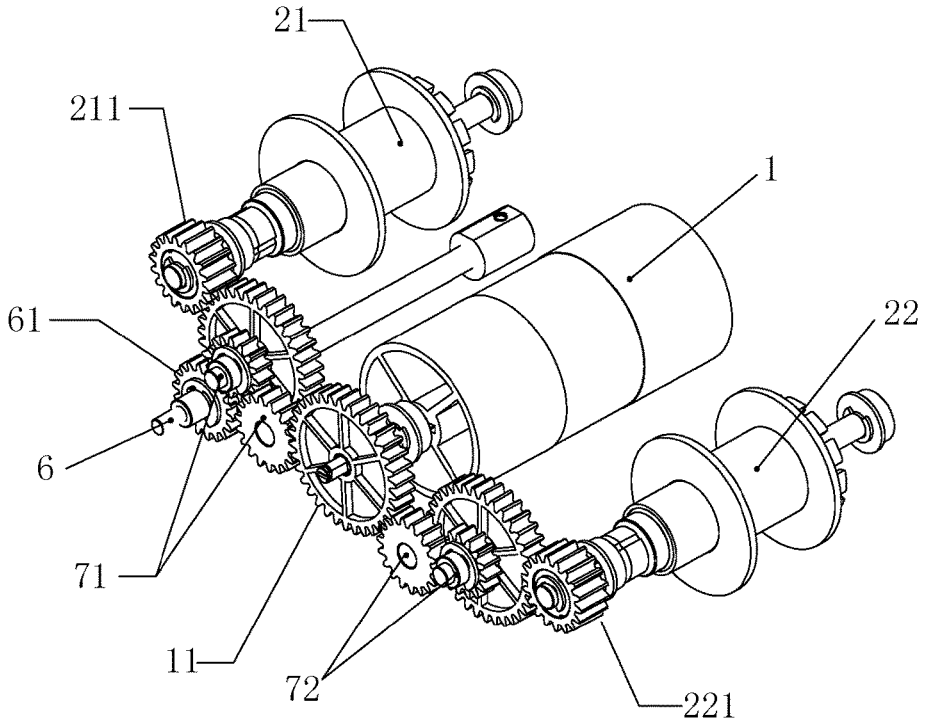
FIG. 2A is a schematic three-dimensional view showing the structure of a synchronous gear transmission system.
Figure 2B:
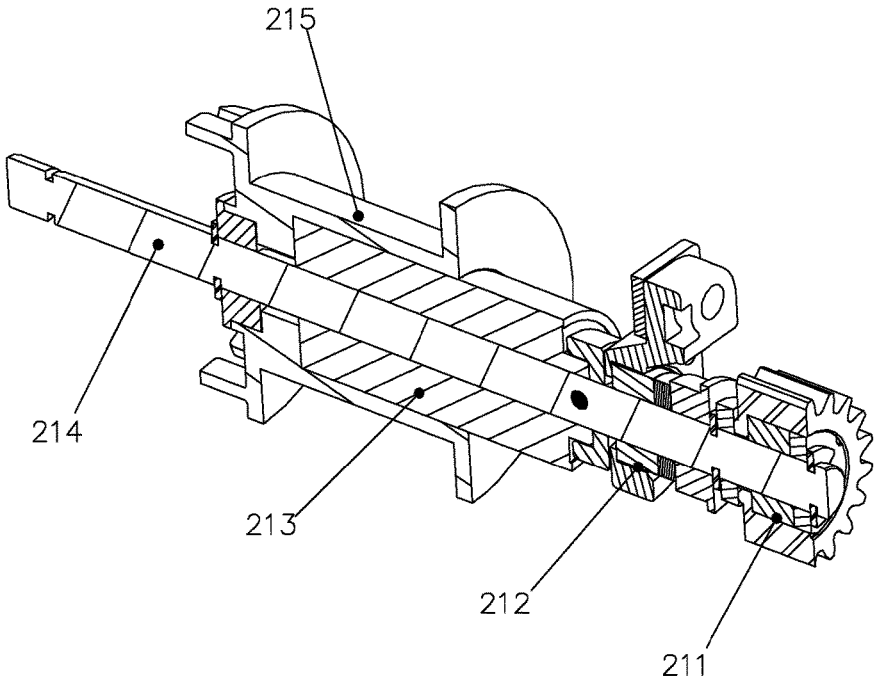
FIG. 2B is a schematic three-dimensional sectional view of a first tape withdrawing reel assembly.
Figure 2C:
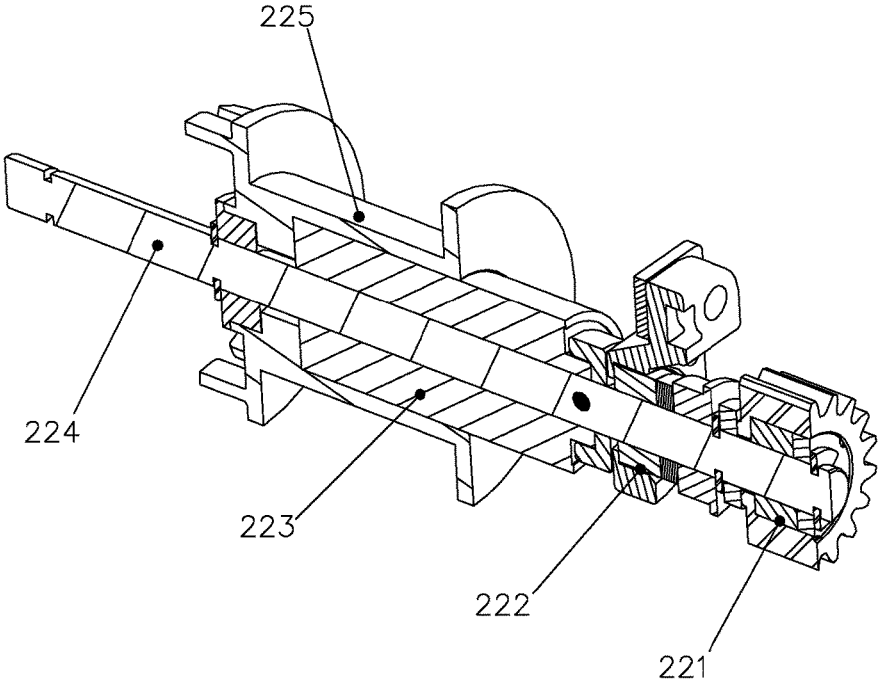
FIG. 2C is a schematic three-dimensional sectional view of a second tape withdrawing reel assembly.
Figure 3:
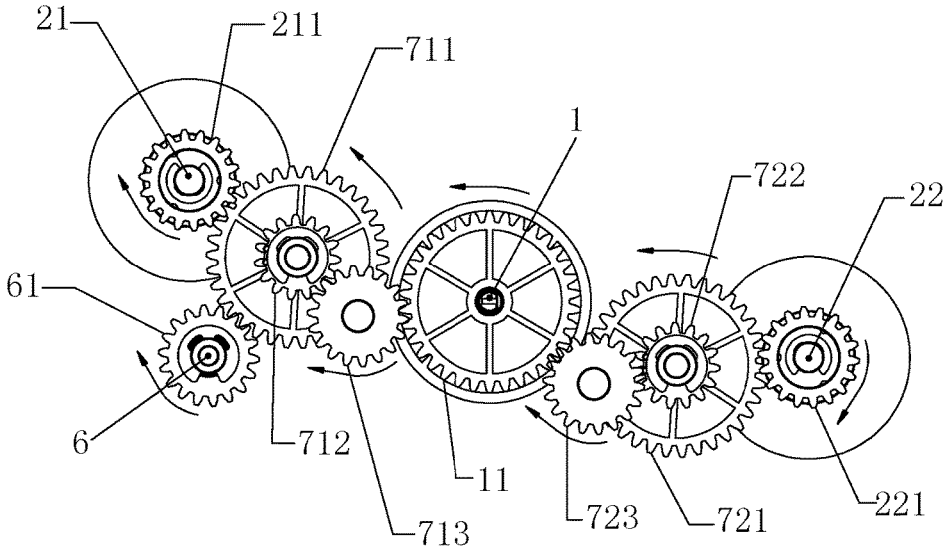
FIG. 3 is a schematic view showing the working principle of the synchronous gear transmission system.

FIG. 1 is a schematic view showing the structure of a double-tape banknote temporary storage device according to a preferred embodiment of the present application. The double-tape banknote temporary storage device includes a banknote temporary storage reel 1, a pair of tape withdrawing reel assemblies 2, two tapes 4, a pair of tape pressing wheels 5 and a planetary gear decelerating motor 3. With reference to FIGS. 2A and 3, the banknote temporary storage reel 1 is configured to wind the pair of tapes 4 with banknotes stored therebetween, and the pair of tape withdrawing reel assemblies are located respectively at two sides of the banknote temporary storage reel, and are each configured to wind an individual tape after banknotes are released. For ease of distinguishing the pair of tape withdrawing reel assemblies, the pair of tape withdrawing reel assemblies 2 are respectively indicated as 21 and 22 in FIGS. 2A and 3. Referring to FIG. 2B, the first tape withdrawing reel assembly 21 includes a first counterclockwise one-way drive gear 211, a first clockwise one-way bearing fixing seat 212, a first torsion limiter 213, a first rotating shaft 214 and a first tape withdrawing reel 215. Specifically, an inner ring of the first torsion limiter 213 is fixed onto the first rotating shaft 214 by a cylindrical pin, and a pin key on an outer ring of the first torsion limiter 213 is engaged with a pin key on an inner ring of the first tape withdrawing reel 215. The first clockwise one-way bearing fixing seat 212 is arranged at the right of the first torsion limiter 213, an inner ring of the first clockwise one-way bearing fixing seat 212 is sleeved on the first rotating shaft 214, and an outer ring of the first clockwise one-way bearing fixing seat 212 is fixed to a sheet metal side plate. The first counterclockwise one-way drive gear 211 is arranged at the right of the first clockwise one-way bearing fixing seat 212. An inner ring of the first counterclockwise one-way drive gear 211 is sleeved on the first rotating shaft 214 and the first counterclockwise one-way drive gear 211 is engaged with a gear 711 in a synchronous gear transmission system. The second tape withdrawing reel assembly 22 has the same structure with the first tape withdrawing reel assembly 21. As shown in FIG. 2C, the second tape withdrawing reel assembly 22 includes a second counterclockwise one-way drive gear 221, a second clockwise one-way bearing fixing seat 222, a second torsion limiter 223, a second rotating shaft 224 and a second tape withdrawing reel 225. Specifically, an inner ring of the second torsion limiter 223 is fixed onto the second rotating shaft 224 by a cylindrical pin, and a pin key on an outer ring of the second torsion limiter 223 is engaged with a pin key on an inner ring of the second tape withdrawing reel 225. The second clockwise one-way bearing fixing seat 222 is arranged at the right of the second torsion limiter 223, an inner ring of the second clockwise one-way bearing fixing seat 222 is sleeved on the second rotating shaft 224, and an outer ring of the second clockwise one-way bearing fixing seat 222 is fixed to a sheet metal side plate. The second counterclockwise one-way drive gear 221 is arranged at the right of the second clockwise one-way bearing fixing seat 222. An inner ring of the second counterclockwise one-way drive gear 221 is sleeved on the second rotating shaft 224 and the second counterclockwise one-way drive gear 221 is engaged with a gear 721 in the synchronous gear transmission system. Two ends of the pair of tapes align with each other and are fixed onto the banknote temporary storage reel 1, and another two ends of the pair of tapes are fixed respectively onto the pair of tape withdrawing reel assemblies 21 and 22. The pair of tape pressing wheels are located between the banknote temporary storage reel 1 and respective tape withdrawing reel assemblies 2 for pressing the two ends, close to the banknote temporary storage reel 1, of the pair of tapes 4 to approach each other and forming a stretch of double-tape conveying passage. A driving gear 61 is provided on an output shaft 6 of the planetary gear decelerating motor 3. Power of the planetary gear decelerating motor 3 is transmitted to the banknote temporary storage reel 1 and the pair of tape withdrawing reels 2 by the synchronous gear transmission system, and the synchronous gear transmission system includes: a first gear 11 configured to drive the banknote temporary storage reel 1, a first transmission gear set 71 engaged with the driving gear 61, and a second transmission gear set 72 connecting the first gear 11 and the second counterclockwise one-way drive gear 221.

Specifically, as shown in FIGS. 2A and 3, the first transmission gear set 71 includes a coaxial gear set and a first transmission gear 713. The coaxial gear set includes a large gear 711 and a small gear 712 which are arranged coaxially. The large gear 711 is engaged with the driving gear 61 and is also engaged with the first counterclockwise one-way drive gear 211, so as to transmit power of the driving gear 61 to the first counterclockwise one-way drive gear 211 and further drive the first tape withdrawing reel assembly 21 to rotate.

Meanwhile, the first transmission gear 713 is located between the small gear 712 and the first gear 11, and is engaged with respectively the small gear 712 and the first gear 11, so as to transmit the power of the driving gear 61 to the first gear 11 and further drive the banknote temporary storage reel 1 to rotate.

In addition, the second transmission gear set 72 includes a second coaxial gear set and a second transmission gear 723. The second coaxial gear set includes a second large gear 721 and a second small gear 722 which are coaxially arranged. The second small gear 722 is engaged with the second transmission gear 723, the second transmission gear 723 is also engaged with the first gear 11, and the second large gear 721 is engaged with the second counterclockwise one-way drive gear 221 so as to transmit the power of the driving gear 61 to the second counterclockwise one-way drive gear 221 and further drive the second tape withdrawing reel assembly 22 to rotate.

Preferably, the first transmission gear set 71 and the second transmission gear set 72 are two-stage decelerating gears, which have a function of decelerating and torque increasing and can reduce the load of the motor effectively.

The working principle of the double-tape banknote temporary storage device is described hereinafter. As shown in FIG. 3, the planetary gear decelerating motor 3 drives the banknote temporary storage reel 1 and the two tape temporary storage reels 2 to move synchronously via the synchronous gear transmission system. In the case that the banknote temporary storage reel 1 rotates counterclockwise, with reference to FIGS. 2B, 2C, and 3, the first counterclockwise one-way drive gear 211 rotates clockwise, and the first counterclockwise one-way drive gear 211 slips with respect to the first rotating shaft 214, and the first counterclockwise one-way drive gear 211 does not transmit torque, similarly, the second clockwise one-way drive gear 221 does not transmit torque. The two tape temporary storage reel assemblies 2 rotate clockwise synchronously under the action of the drawing force of the tapes and uncoil the tapes 4, and the double tapes 4 are received on the banknote temporary storage reel 1. In the case that a banknote enters the tape passage, the banknote will be held by the double tapes 4 and wound on the banknote temporary storage reel 1 in a ring-shape for achieving the function of banknote temporary storage. Contrarily, in the case that the banknote temporary storage reel 1 rotates clockwise, the first counterclockwise one-way drive gear 211 rotates counterclockwise, the first counterclockwise one-way drive gear 211 drives the first rotating shaft 214 to rotate counterclockwise, and the first rotating shaft 214 transmits the torque to the first tape withdrawing reel 215 via the first torsion limiter 213. The first tape withdrawing reel 215 rotates counterclockwise to withdraw the tape, in this process, since the first rotating shaft 214 and the first tape withdrawing reel 215 have an instantaneous linear velocity difference with each other, causing instantaneous slipping of the inner ring and the outer ring of the first torsion limiter 213, and the instantaneous slipping friction torque caused by the sipping will compensate torque difference caused by the linear velocity difference, which allows the linear velocities of two ends of the tapes 4 to be synchronous. By this principle, two tape withdrawing reel assemblies 21 and 22 withdraw the double tapes 4 at the same time, and the banknotes are held by the double tapes 4 and are conveyed out of the tape passage.

As another preferred embodiment according to the present application, a clutch 8 is provided on the output shaft 6 of the planetary gear decelerating motor 3 for achieving engagement and disengagement between the output shaft 6 of the planetary gear decelerating motor and the synchronous gear transmission system. In this embodiment, the clutch 8 replaces the driving gear 61 in the embodiment described previously, and other parts are the same with the embodiment described previously. In normal working condition, the working manner of this embodiment is completely the same with the above embodiment. However, when power is off and the apparatus is stopped, the output shaft of the planetary gear decelerating motor may be separated from the gear at an input end of the synchronous gear transmission system by the clutch, therefore, the synchronous gear transmission system may be driven by an manual operation, thereby performing maintenance of the double-tape banknote temporary storage device when power is off.

Figure 4:
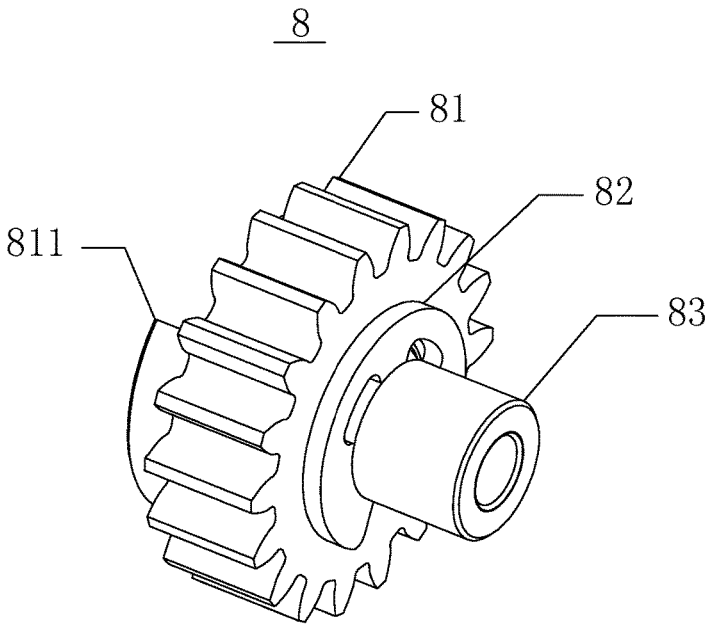
FIG. 4 is a schematic perspective view showing the structure of a clutch in the case that an output shaft of a planetary gear decelerating motor is provided with the clutch according to another preferred embodiment of the present application.
Figure 5:
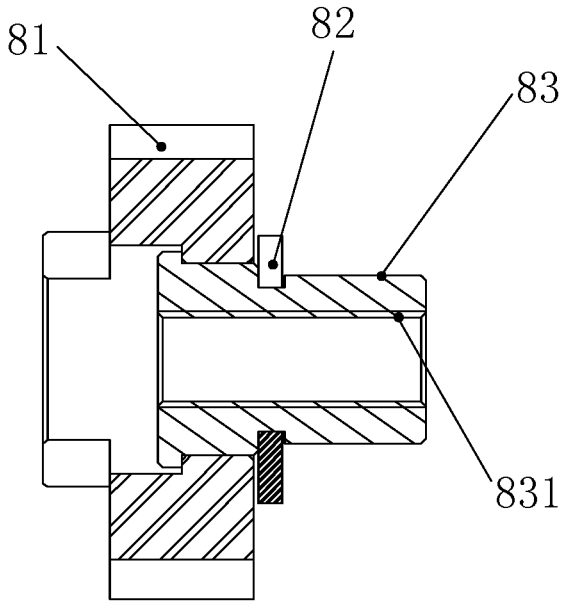
FIG. 5 is a schematic sectional view showing the structure of the clutch in FIG. 4.
Figure 6:
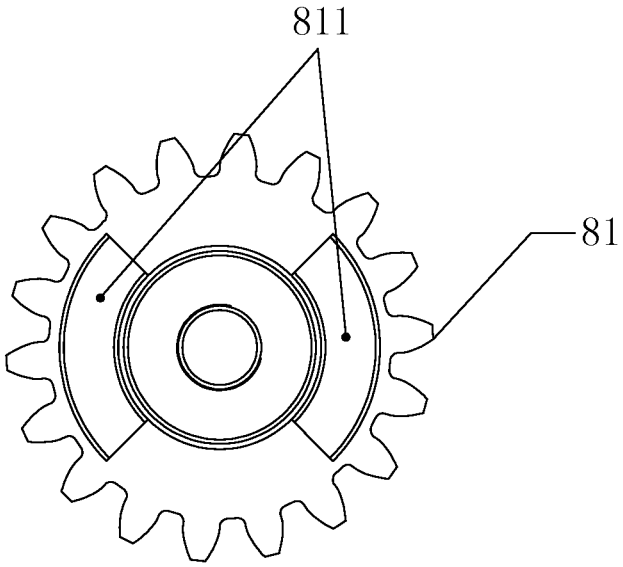
FIG. 6 is a schematic view showing the structure of a gear side of the clutch, and mainly showing an engaging boss structure arranged on the gear side of the clutch in FIG. 4.
Figure 7:
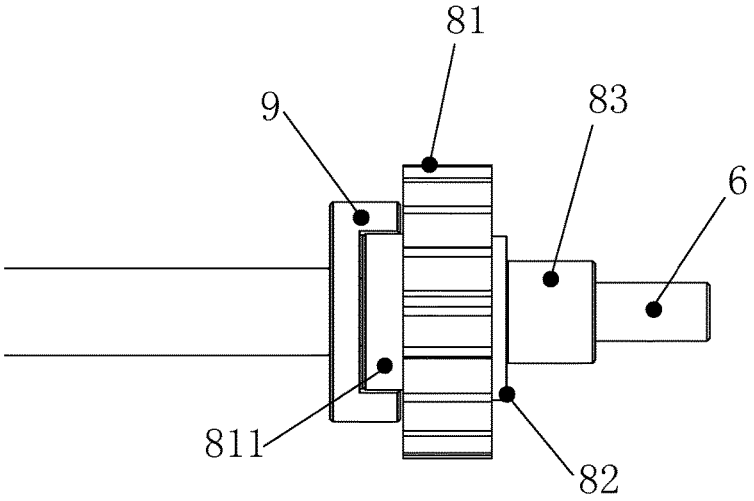
FIG. 7 is a schematic view showing that the clutch is assembled on the output shaft of the planetary gear decelerating motor and is in an engaged state.

Specifically, as shown in FIG. 4, the clutch includes a clutch gear 81, a split washer 82 and a hollow clutch movable shaft 83. As shown in FIG. 5, the clutch gear 81 is sleeved on the clutch movable shaft 83, and is axially limited on the clutch movable shaft 83 by the split washer 82 and a retaining edge of the clutch movable shaft 83. Referring to FIGS. 6 and 4, an engaging boss structure 811 is provided at one side of the clutch gear 81, and the clutch gear 81 is rotatable freely on the clutch movable shaft 83, and an inner surface of the clutch movable shaft 83 is provided with screw threads 831. Referring again to FIG. 7, a clutch engaging block 9 is further provided on the output shaft 6 of the planetary gear decelerating motor, and the clutch 8 is secured onto the output shaft 6 of the planetary gear decelerating motor by the screw threads 831 on the inner surface of the clutch movable shaft 83, and the clutch 8 is engaged with the clutch engaging block 9 by the engaging boss structure 811 on one side of the clutch gear 81, thereby achieving torque transmission. That is, in the case that the clutch 8 is engaged with the clutch engaging block 9 and the planetary gear decelerating motor 3 rotates, the output shaft 6 rotates, and the clutch gear 81 is driven to rotate. The clutch gear 81 is just equivalent to the driving gear 61 in the above embodiment. In the case that the clutch gear 81 rotates, the gear at the input end of the synchronous gear transmission system is driven to rotate, thus by the transmission of the synchronous gear transmission system, the banknote temporary storage reel 1 and the tape temporary storage reel 2 are simultaneously driven to rotate, which achieves the functions of temporary storage or output of banknotes.

In the case that the clutch movable shaft 83 on the clutch 8 is rotated by an manual operation, the clutch 8 moves outwards along a thread path of the clutch 8, which allows the gear 81 on the clutch 8 to be disengaged from the clutch engaging block 9, thus separating the output shaft 6 of the planetary gear decelerating motor 3 from the synchronous gear transmission system. In this case, the synchronous gear transmission system may be driven by the manual operation, which allows the apparatus to be maintained when power is off, allows trouble to be shot rapidly and more efficient, and facilitates maintenance.

The above description is only preferred embodiments of the present application. It should be noted that, the above preferred embodiments should not be deemed as a limitation to the present application, and the scope of the present application is defined by the claims of the present application. For the person skilled in the art, several improvements and modifications may be made to the present application without departing from the spirit and scope of the present application, and these improvements and modifications are also deemed to fall into the scope of the present application.

The invention claimed is:

1. A double-tape banknote temporary storage device, comprising:

a banknote temporary storage reel configured to wind a pair of tapes with banknotes stored between the pair of tapes;

a pair of tape withdrawing reel assemblies being a first tape withdrawing reel assembly and a second tape withdrawing reel assembly having the same structure, wherein the first tape withdrawing reel assembly and the second tape withdrawing reel assembly are located respectively at two sides of the banknote temporary storage reel and are each configured to wind an individual tape after the banknotes are released;

a pair of tapes, wherein two ends of the pair of tapes are aligned with each other and fixed onto the banknote temporary storage reel, and another two ends of the pair of tapes are fixed respectively onto the first tape withdrawing reel assembly and the second tape withdrawing reel assembly;

a pair of tape pressing wheels, located between the banknote temporary storage reel and respective tape withdrawing reel assemblies, for pressing the two ends, fixed onto the banknote temporary storage reel, of the pair of tapes to approach each other and forming a double-tape conveying passage;

wherein the double-tape banknote temporary storage device further comprises a planetary gear decelerating motor and a synchronous gear transmission system, and a driving gear is provided on an output shaft of the planetary gear decelerating motor, and the synchronous gear transmission system is configured to transmit power of the planetary gear decelerating motor to both of the banknote temporary storage reel and the pair of tape withdrawing reel assemblies simultaneously, wherein the synchronous gear transmission system comprises a first gear configured to drive the banknote temporary storage reel, a first transmission gear set engaged with the driving gear and transmitting power to both of the banknote temporary storage reel and the first tape withdrawing reel assembly simultaneously, and a second transmission gear set connecting the first gear and the second tape withdrawing reel assembly and transmitting power to the second tape withdrawing reel assembly.

2. The double-tape banknote temporary storage device according to claim 1, wherein the first tape withdrawing reel assembly comprises a first counterclockwise one-way drive gear, a first clockwise one-way bearing fixing seat, a first torsion limiter, a first rotating shaft and a first tape withdrawing reel, wherein an inner ring of the first torsion limiter is fixed onto the first rotating shaft by a cylindrical pin, and a pin key on an outer ring of the first torsion limiter is engaged with a pin key on an inner ring of the first tape withdrawing reel, the first clockwise one-way bearing fixing seat is arranged at the right of the first torsion limiter, an inner ring of the first clockwise one-way bearing fixing seat is sleeved on the first rotating shaft, and an outer ring of the first clockwise one-way bearing fixing seat is fixed to a sheet metal side plate, the first counterclockwise one-way drive gear is arranged at the right of the first clockwise one-way bearing fixing seat, and an inner ring of the first counterclockwise one-way drive gear is sleeved on the first rotating shaft and the first counterclockwise one-way drive gear is engaged with the first transmission gear set.

3. The double-tape banknote temporary storage device according to claim 2, wherein the first transmission gear set comprises a coaxial gear set and a first transmission gear, the coaxial gear set comprises a large gear and a small gear which are arranged coaxially, and the large gear is engaged with the driving gear and is also engaged with the first counterclockwise one-way drive gear to transmit power of the driving gear to the first counterclockwise one-way drive gear and further drive the first tape withdrawing reel assembly to rotate.

4. The double-tape banknote temporary storage device according to claim 3, wherein the first transmission gear is located between the small gear and the first gear, and is engaged with the small gear and the first gear to transmit the power of the driving gear to the first gear and further drive the banknote temporary storage reel to rotate.

5. The double-tape banknote temporary storage device according to claim 1, wherein the second tape withdrawing reel assembly comprises a second counterclockwise one-way drive gear, a second clockwise one-way bearing fixing seat, a second torsion limiter, a second rotating shaft and a second tape withdrawing reel, wherein an inner ring of the second torsion limiter is fixed onto the second rotating shaft by a cylindrical pin, and a pin key on an outer ring of the second torsion limiter is engaged with a pin key on an inner ring of the second tape withdrawing reel, the second clockwise one-way bearing fixing seat is arranged at the right of the second torsion limiter, an inner ring of the second clockwise one-way bearing fixing seat is sleeved on the second rotating shaft, and an outer ring of the second clockwise one-way bearing fixing seat is fixed to a sheet metal side plate, the second counterclockwise one-way drive gear is arranged at the right of the second clockwise one-way bearing fixing seat, an inner ring of the second counterclockwise one-way drive gear is sleeved on the second rotating shaft and the second counterclockwise one-way drive gear is engaged with the second transmission gear set.

6. The double-tape banknote temporary storage device according to claim 5, wherein the second transmission gear set comprises a second coaxial gear set and a second transmission gear, the second coaxial gear set comprises a second large gear and a second small gear which are coaxially arranged, and the second small gear is engaged with the second transmission gear, the second transmission gear is also engaged with the first gear simultaneously, and the second large gear is engaged with the second counterclockwise one-way drive gear to transmit the power of the driving gear to the second counterclockwise one-way drive gear and further drive the second tape withdrawing reel to rotate.

7. The double-tape banknote temporary storage device according to claim 1, wherein the first transmission gear set and the second transmission gear set are two-stage decelerating gears.

8. The double-tape banknote temporary storage device according to claim 7, wherein a clutch is provided on the output shaft of the planetary gear decelerating motor for replacing the driving gear, and is configured to achieve engagement and disengagement of the output shaft of the planetary gear decelerating motor and the synchronous gear transmission system.

9. The double-tape banknote temporary storage device according to claim 8, wherein the clutch comprises a clutch gear, a split washer and a hollow clutch movable shaft, the clutch gear is sleeved on the clutch movable shaft, and is axially limited on the clutch movable shaft by the split washer and a retaining edge of the clutch movable shaft, an engaging boss structure is provided at one side of the clutch gear, and the clutch gear is rotatable freely on the clutch movable shaft, and an inner surface of the clutch movable shaft is provided with screw threads, a clutch engaging block is further provided on the output shaft of the planetary gear decelerating motor, and the clutch is secured onto the output shaft of the planetary gear decelerating motor by the screw threads on the inner surface of the clutch movable shaft, and the clutch is engaged with the clutch engaging block by the engaging boss structure on the side of the clutch gear for achieving torque transmission.

10. The double-tape banknote temporary storage device according to claim 2, wherein the first transmission gear set and the second transmission gear set are two-stage decelerating gears.

11. The double-tape banknote temporary storage device according to claim 3, wherein the first transmission gear set and the second transmission gear set are two-stage decelerating gears.

12. The double-tape banknote temporary storage device according to claim 4, wherein the first transmission gear set and the second transmission gear set are two-stage decelerating gears.

13. The double-tape banknote temporary storage device according to claim 5, wherein the first transmission gear set and the second transmission gear set are two-stage decelerating gears.

14. The double-tape banknote temporary storage device according to claim 6, wherein the first transmission gear set and the second transmission gear set are two-stage decelerating gears.

* * * * *